US007140443B2

(12) United States Patent
Beierbach et al.

(10) Patent No.: US 7,140,443 B2
(45) Date of Patent: Nov. 28, 2006

(54) PIPE HANDLING DEVICE, METHOD AND SYSTEM

(75) Inventors: K. Evert Beierbach, Calgary (CA); Kevin Nikiforuk, Calgary (CA)

(73) Assignee: Tesco Corporation, Calgary (CA)

( * ) Notice: Subject to any disclaimer, the term of this patent is extended or adjusted under 35 U.S.C. 154(b) by 218 days.

(21) Appl. No.: 10/704,147

(22) Filed: Nov. 10, 2003

(65) Prior Publication Data

US 2005/0098352 A1 May 12, 2005

(51) Int. Cl.
*E21B 19/16* (2006.01)

(52) U.S. Cl. ..... 166/380; 166/77.52; 166/78.1; 166/85.1; 175/171

(58) Field of Classification Search ..... None
See application file for complete search history.

(56) References Cited

U.S. PATENT DOCUMENTS

| | | | | |
|---|---|---|---|---|
| 3,706,347 | A | 12/1972 | Brown | |
| 3,766,991 | A | 10/1973 | Brown | |
| 3,780,883 | A | 12/1973 | Brown | |
| 3,915,244 | A | 10/1975 | Brown | |
| 4,274,778 | A | 6/1981 | Putnam et al. | |
| 4,625,796 | A * | 12/1986 | Boyadjieff | 166/77.52 |
| 5,107,940 | A | 4/1992 | Berry | |
| 6,276,450 | B1 | 8/2001 | Seneviratne | |
| 6,527,047 | B1 | 3/2003 | Pietras | |

FOREIGN PATENT DOCUMENTS

| | | |
|---|---|---|
| WO | WO 98/11322 | 3/1998 |
| WO | WO 99/30000 | 6/1999 |

OTHER PUBLICATIONS

Society of Petroleum Engineers, SPE/IADC 52770 Case Running Tool by G. H. Kamphorst, G. L. van Wecham, W. Boom, D. Bottger, K. Koch; pp. 89-97, 1999.

* cited by examiner

*Primary Examiner*—Zakiya W. Bates
(74) *Attorney, Agent, or Firm*—Bennett Jones LLP

(57) ABSTRACT

A pipe handling device for mounting to use with a top drive and possibly a pipe engaging apparatus, includes a link arm having a first end pivotally connectable to move with the top drive and an outboard end pivotally connectable to a pipe elevator segment, and a drive system to drive the outboard end of the link arm at least between a lower position and a raised position. A pipe handling system and method may include or employ the pipe handling device.

70 Claims, 6 Drawing Sheets

PIPE HANDLING DEVICE, METHOD AND SYSTEM

FIELD OF THE INVENTION

The invention relates to a pipe handling device, method and system and, in particular, a pipe handling device, method and system for a pipe joint used in drilling or lining a wellbore.

BACKGROUND

A top drive can be used in a drilling rig for handling a pipe string during drilling or lining a wellbore. In some well operations, an engaging apparatus, including an internal or external pipe gripping mechanism, can be connected below the top drive to grip a joint of pipe, such as casing, so that the engaging apparatus and the joint of pipe can be driven axially and/or rotationally by the top drive. Some engaging apparatus for casing pipe are described in U.S. Pat. No. 6,311,792, issued November 2001 and International application WO00/05483, published February 2000, both to TESCO Corporation.

In a drilling rig, the top drive can be hung in the mast with the engaging apparatus connected in drive communication and in substantial axial alignment therebelow. The top drive and engaging apparatus are hung in the mast above the well center, the top drive and engaging apparatus define a main axis of the drilling rig that is aligned with well center. Joints of pipe, for connection into the drill or liner string, can be supported, for example in a V-door, adjacent the main axis of the drilling rig. For connection into the drill or liner string, the pipe joints can be engaged by an elevator and brought under the drive system for engagement and handling. Generally, the elevator is supported on link arms suspended from the top drive or cables extending from the top drive link arms.

To pick up a pipe joint, the top drive is lowered to permit the elevator, either on conventional link arms or with the cables attached to the link arms, to be manually moved over and engaged about a pipe joint on the V-door. The top drive is then hoisted to pull the pipe joint off the V-door. Once free of the V-door, the pipe joint can be swung by gravity under the engaging apparatus so that the gripping mechanism can engage the pipe joint.

SUMMARY

A pipe handling device and system are disclosed for handling a pipe for use in drilling and/or lining a wellbore.

In accordance with one aspect of the present invention, a pipe handling device for mounting to move with a top drive, the pipe handling device comprising a link arm having a first end and an outboard end, the first end being mounted to a support surface, moveable with the top drive, by a pivotal connection such that the link arm is rotatable in a plane about the pivotal connection at least between a lower position and a raised position and is substantially stabilized against lateral movement out of the plane when in the lower position and the outboard end of the link arm being connectable to a pipe elevator segment and positioned to grip a pipe and present the pipe to be engaged for movement with the top drive and a drive system to drive the link arm about its pivotal connection.

In accordance with another aspect of the present invention, a pipe handling device for mounting onto a pipe engaging apparatus is provided, the pipe engaging apparatus including a main body and a pipe gripping mechanism to grip a pipe for rotational and axial movement thereof and being connectable to a top drive, the pipe handling device comprising: a link arm having a first end pivotally connectable to the pipe engaging apparatus and an outboard end pivotally connectable to a pipe elevator segment, the link arm being sized to present the pipe into a position to be gripped by the pipe engaging apparatus and a drive system to drive the outboard end the link arm out from the pipe engaging apparatus.

In accordance with another aspect of the present invention there is provided a pipe handling system comprising: a pipe engaging apparatus for gripping a pipe joint and having a main body including an upper end for drive connection to a top drive and a pipe gripping mechanism, a link arm including a pivotal connection to the pipe engaging apparatus main body and an outboard end and the link arm being elongate to extend to a position below the pipe gripping mechanism and a link arm drive system for driving the link arm about its pivotal connection.

In accordance with another broad aspect of the present invention, there is provided a method for handling pipe in a rig, the rig including a top drive with a pipe engaging apparatus secured therebelow and a link arm on the pipe engaging apparatus and driven to pivot relative to the pipe engaging apparatus, the method comprising: using the link arm to pick up a pipe from a pipe supply, hoisting the top drive in the rig such that the pipe is rotated to a substantially vertical position while remaining engaged by the link arms, positioning a lower end of the pipe onto a joint positioned in the rotary table such that the pipe is supported thereby, slidably holding an upper portion of the pipe with the link arm and lowering the top drive until the upper portion of the pipe is engaged by the pipe engaging apparatus.

In accordance with another broad aspect of the present invention, there is provided a method for handling pipe in a rig, the rig including a top drive with a pipe engaging apparatus secured therebelow to define a main axis of the rig, the method including: providing a link arm mounted by a pivotal connection to move with the top drive, the link arm driven to pivot about its pivotal connection through a plane of rotation at least between a lowered position and a raised position and substantially stabilized when in the lowered position against moving out of the plane of rotation, using the link arm to pick up a pipe from a pipe supply, hoisting the top drive in the rig such that the pipe is rotated to a substantially vertical position while remaining engaged by the link arm, positioning a lower end of the pipe section onto a joint positioned in the rotary table such that the pipe is supported thereby, slidably holding an upper portion of the pipe with the link arm and lowering the top drive until the upper portion of the pipe is engaged by the pipe engaging apparatus.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION

In one embodiment, a pipe handling device can include a link arm having a first end and an outboard end, the first end of the link arm being mounted to a support surface by a pivotal connection such that the link arm is rotatable in a plane about the pivotal connection at least between a lower position and a raised position and is substantially stabilized against lateral movement out of the plane when in the lower position. The outboard end of the link arm can be connectable to a pipe elevator segment. The pipe handling device can further include a drive system to drive the link arm about its pivotal connection. The support surface can be moveable with the top drive and can, for example, be a portion of a top drive or a pipe engaging apparatus or another surface connected in some way to move with the top drive.

The link arm can be substantially stabilized in a number of ways to permit it to tend to remain in its plane of rotation. In one embodiment, the pivotal connection can include an axle shaft, with a long axis, and a support to retain the link arm to rotate in a plane substantially orthogonal to the long axis of the axle shaft. In another embodiment, guides can be provided into which the link arm can enter when in the lower position, the guides being formed to hold the arm against lateral movement. In another embodiment, the link arms or the support surface can include spacers to maintain at least a selected spacing therebetween, thereby stabilizing the link arms to tend to remain in their plane of rotation when in the lower position. This substantial stabilization of the link arm can provide lateral support link arms to maintain them in a parallel plane to the rig axis and, thereby to provide lateral support to a pipe joint gripped by the pipe handling device facilitating alignment of the gripped pipe with the pipe engaging apparatus.

In another embodiment, a pipe handling device for mounting onto a pipe engaging apparatus can be provided. The pipe engaging apparatus can be one including a main body and pipe gripping members and can be connectable to a top drive. The pipe handling device can include a link arm having a first end pivotally connectable to the pipe engaging apparatus and an outboard end pivotally connectable to a pipe elevator segment, and a drive system to drive the outboard end of the link arm out from the pipe engaging apparatus.

Figure 1:
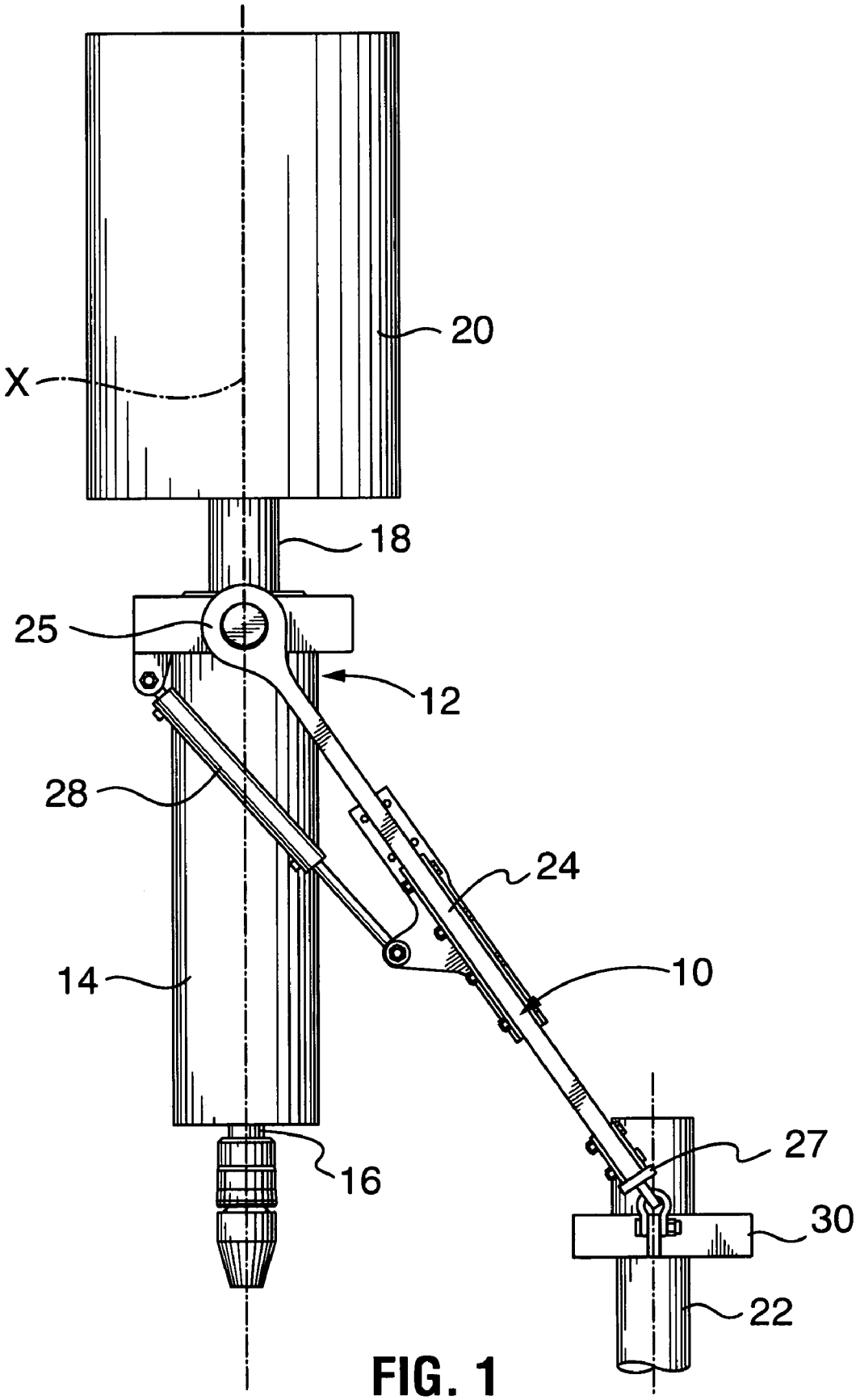
FIG. 1 is a schematic side view of one embodiment of a pipe handling device mounted on a support surface and carrying a pipe elevator.

A pipe handling device 10 is shown in FIG. 1. The illustrated pipe handling device can be mounted onto a pipe engaging apparatus 12 including a main body 14 and pipe gripping members 16. The pipe engaging apparatus can be connectable, directly or indirectly, at its upper end 18 to a top drive 20. The pipe engaging apparatus can be selected to grip, through pipe gripping members 16, a pipe 22 for rotational and/or axial movement thereof, as driven by top drive 20.

Pipe handling device 10, when mounted to move with a top drive such as, for example, in association with a pipe engaging apparatus 12, can be used to bring a pipe from a pipe supply into a position for engagement by the pipe engaging apparatus, for example substantially into the rig main axis x above hole center.

Pipe handling device 10 can include one or more link arms. In the illustrated embodiment, device 10 includes a first link arm 24 and a second link arm (cannot be seen). The first and second link arms can each include a first end 25 pivotally connectable to the main body of the pipe engaging apparatus and an outboard end 27. The pipe handling device further can include a drive system 28 to drive outboard ends 27 of the first link arm and the second link arm in substantial unison relative to pipe engaging apparatus 12 using the pivotal movement permitted by first ends 25. Outboard ends 27 can be connected to a pipe elevator 30 for engaging pipe 22. As such, when outboard ends 27 are driven out relative to the main body, the pipe elevator can be moved out, for example to be engaged about a pipe from a pipe supply.

Outboard ends 27 can be distanced from first ends 25 a distance to permit the pipe elevator to be brought into the rig main axis below the pipe engaging apparatus. While first link arm 24 is shown as a member of fixed length, in another embodiment, these arms can each be formed of telescoping members permitting selection of the length of the link arms. The telescoping members can be driven manually or automatically, such as by hydraulics. In an automatic embodiment, link arms can be driven to pull or push, if desired, a pipe engaged thereon, for example, to facilitate conveying or positioning the pipe.

Elevator 30 can be manually actuable to be secured about or release a pipe. Alternately, the elevator can be mechanized to be automatically openable/closable by a tool operator, who, for example, can be positioned remote from the elevator. The automatic actuation of the elevator can be provided, for example, by hydraulics acting between the elevator parts.

Figure 2A:
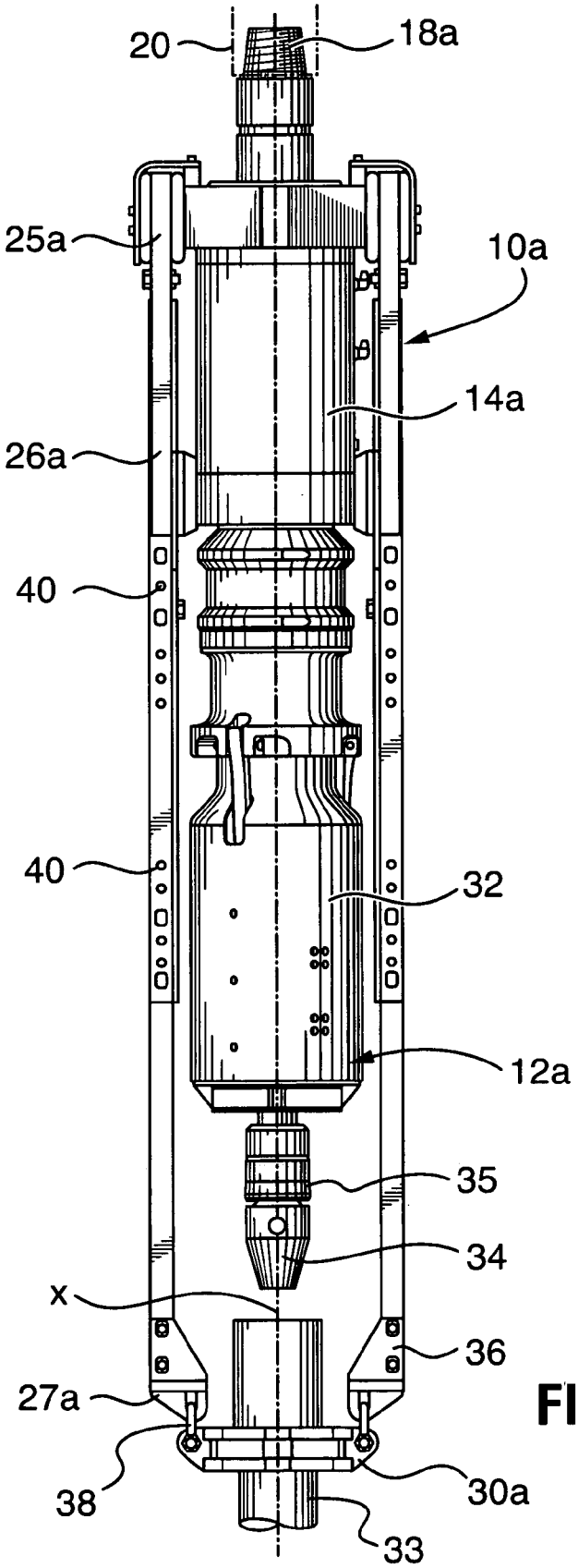
FIGS. 2*a* and 2*b* are front and side elevations, respectively, of a pipe handling system.
Figure 2B:
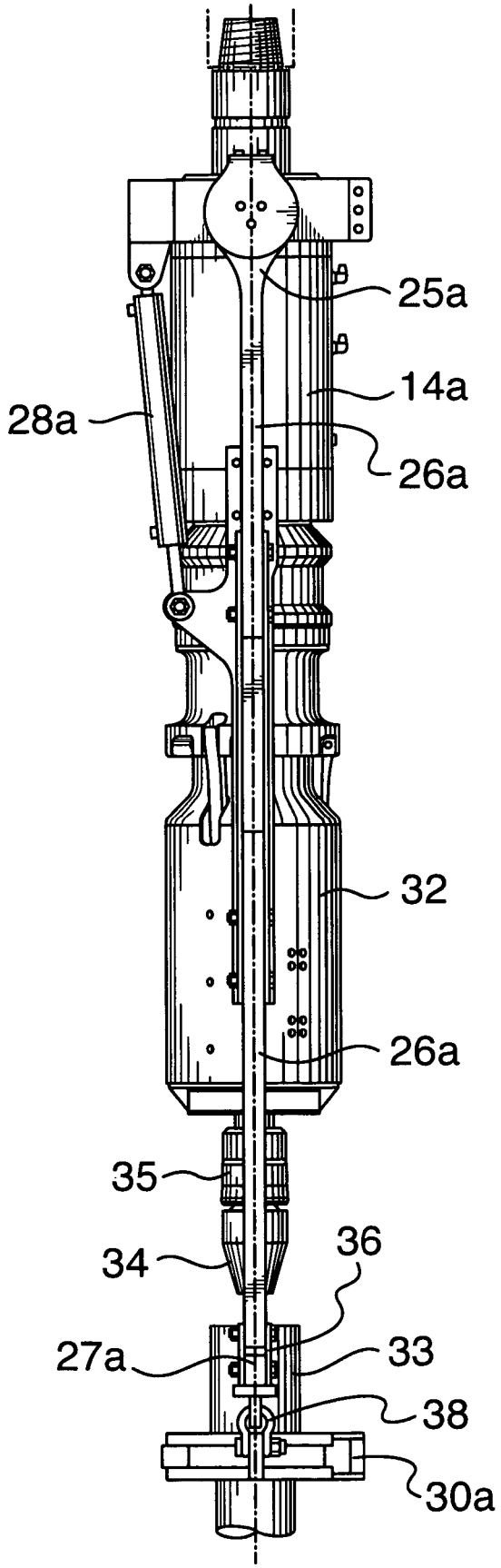
Figure 2C:
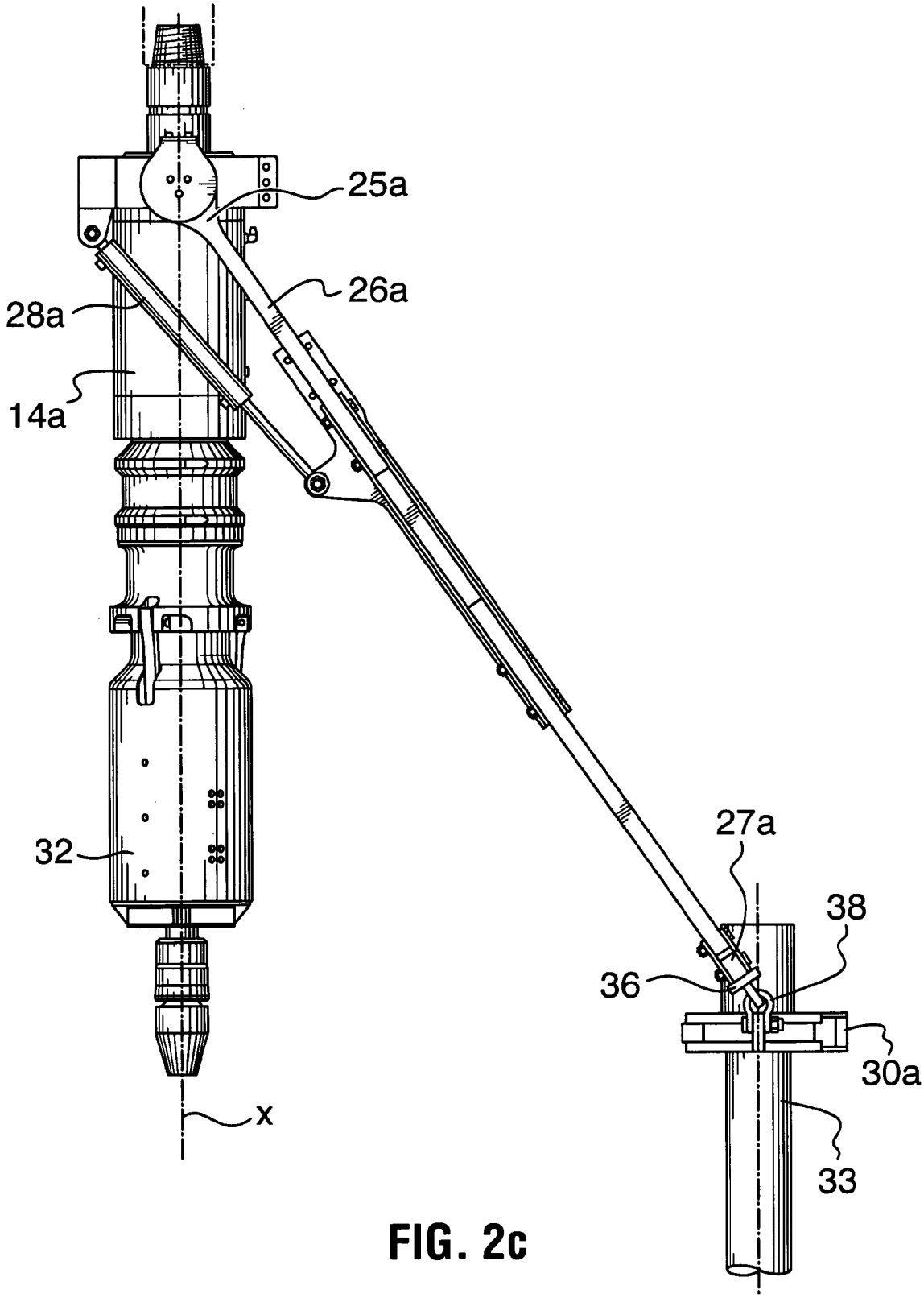
FIG. 2*c* is a side elevation corresponding to FIG. 2*b*, but with the link arms extended.

Referring to FIG. 2, a pipe handling system is shown including a pipe handling device 10*a* and a pipe engaging apparatus 12*a* including a main body 14*a* and a housing 32 carrying, for example, inwardly directed grapples, which can't be seen in this drawing, formed to engage about the outer surface of a pipe, such as a section of casing 33, to be gripped. The pipe engaging apparatus can, for example, include a stabbing guide 34 and packer arrangement 35 for insertion into the inner diameter of the pipe to be gripped. Pipe engaging apparatus 12*a* can be, for example, an external casing drive assembly as is available from TESCO Corporation.

The pipe engaging apparatus can be formed at its upper end 18*a* as a pin for connection to a top drive, indicated in part at 20. The pipe engaging apparatus can be selected to grip, through the grapples, section of casing 33, for rotational and/or axial movement thereof, as driven by the top drive. The section of casing can be one or more joints of casing to be added to or removed from a casing string for drilling or lining a wellbore, the section of casing can include couplers and/or other internally or externally connected tools or devices.

Pipe handling device 10*a* can be used to bring section of casing 33 from a pipe supply into a position for engagement by pipe engaging apparatus 12*a*.

Pipe handling device 10*a* can include a first link arm 24*a* and a second link arm 26*a*. The first and second link arms can each include a first end 25*a* pivotally connectable to the main body of the pipe engaging apparatus and an outboard end 27*a*.

The pipe handling device further can include a drive system 28*a*, including, for example, hydraulic cylinders, air cylinders, screw drives, gear drives etc., to drive outboard ends 25*a* of the first link arm and the second link arm relative to pipe engaging apparatus 12*a*, as permitted by the pivotal connections at first ends 25*a*. Outboard ends 27*a* can be connected to a pipe elevator 30*a* for engaging casing section 33. As such, when outboard ends 27*a* are driven out relative to the main body, the pipe elevator can be moved out to pick up the casing section from, or move the casing section to, a V-door or other pipe supply (not shown).

The outboard ends can include or have secured thereto an apertured block 36 for accepting a clevis link 38 for connection to the elevator. Thus pivotal movement is permitted at this connection and elevators can be changed out to correspond to the pipe outer diameter to be handled.

The link arms can be formed as telescoping parts for length adjustment. For example, the link arms can each include a first section and a second section connected by a sleeve or channel section including alignable apertures 40 in the sections and the sleeve for pinning therethrough to lock the link arm length.

The pivotal connection at first end can be selected to tend to hold the link arms from lateral movement, maintaining rotation of the link arms in planes parallel to each other. In one embodiment, the connection holds the link arms equidistant from the drilling rig main axis x, which passes through the long axis of the pipe gripping apparatus. These features of the pipe handling device can facilitate connection of the pipe engaging apparatus to the casing, by holding the casing aligned and stationary with the pipe engaging apparatus.

In one embodiment, the link arms can be positioned on either side of the pipe gripping apparatus and in a plane passing through the long axis of the pipe gripping apparatus and the link arms.

In operation, the pipe handling system components including, pipe engaging apparatus 12*a* and elevator 30*a*, can be selected for the pipe size to be handled. The pipe handling system is assembled and pin end 18*a* can be installed on the bottom of a top drive in a rig. To pick up a section of casing, the top drive is lowered to move the pipe handling system down toward the rig floor. Link arms 24*a*, 26*a* are then rotated out (FIG. 2*b*), by drive system 28*a* (as controlled by, for example, a tool operator) toward a casing section 33 supported in the V-door. A person on the rig floor connects elevator 30*a* about casing section 33 so that elevator can catch on its upset. Alternately, where the elevator is mechanized, the elevator can be remotely connected about the casing section, without requiring handling by a rig hand. Drive system 28*a* can be used to facilitate positioning of the link arms and the elevator, for example, to minimize efforts required by rig floor personnel.

The top drive is then hoisted in the rig and carries the pipe handling system with it. When moving up, drive system 28*a* can be disengaged so that the link arms are free to pivot about their upper ends 25*a*, as driven by their weight and the weight of the casing section supported in elevator 30*a*.

Once the casing section is clear of the V-door it will hang in the elevator and can be positioned over the well center (FIGS. 2*a*, 2*b*) and set down in the stump of pipe string supported on the rig floor. Once the casing section is located and supported in the stump at hole center, the top drive can be lowered. This will bring the pipe engaging apparatus down onto or into the casing section upper end so that the grapples can be driven into engagement with it. If necessary to facilitate alignment and engagement, drive system 28*a* can be driven to bring or maintain the casing section into alignment with stabbing guide 34 of the pipe engaging apparatus. When the casing section is supported in the stump and the top drive is lowered, elevator 30*a* slides down away from the upset, but continues to hold and remains connected, albeit loosely, about the casing section.

Once engaged by the pipe engaging apparatus, the casing section can be driven by the top drive. For example, it can be driven to thread into the connection of the stump. Thereafter, the casing section and the string now connected thereto can be lowered by the top drive into the rig center hole. As the casing section is lowered to the rig floor by the pipe engaging apparatus, the elevator can be disconnected and rotated out in preparation to accept another casing section.

When the top of the casing section is supported in the rig floor, the elevator can be engaged onto the next casing section, thereby picking it up as the top drive and pipe engaging apparatus are hoisted.

Figure 3:
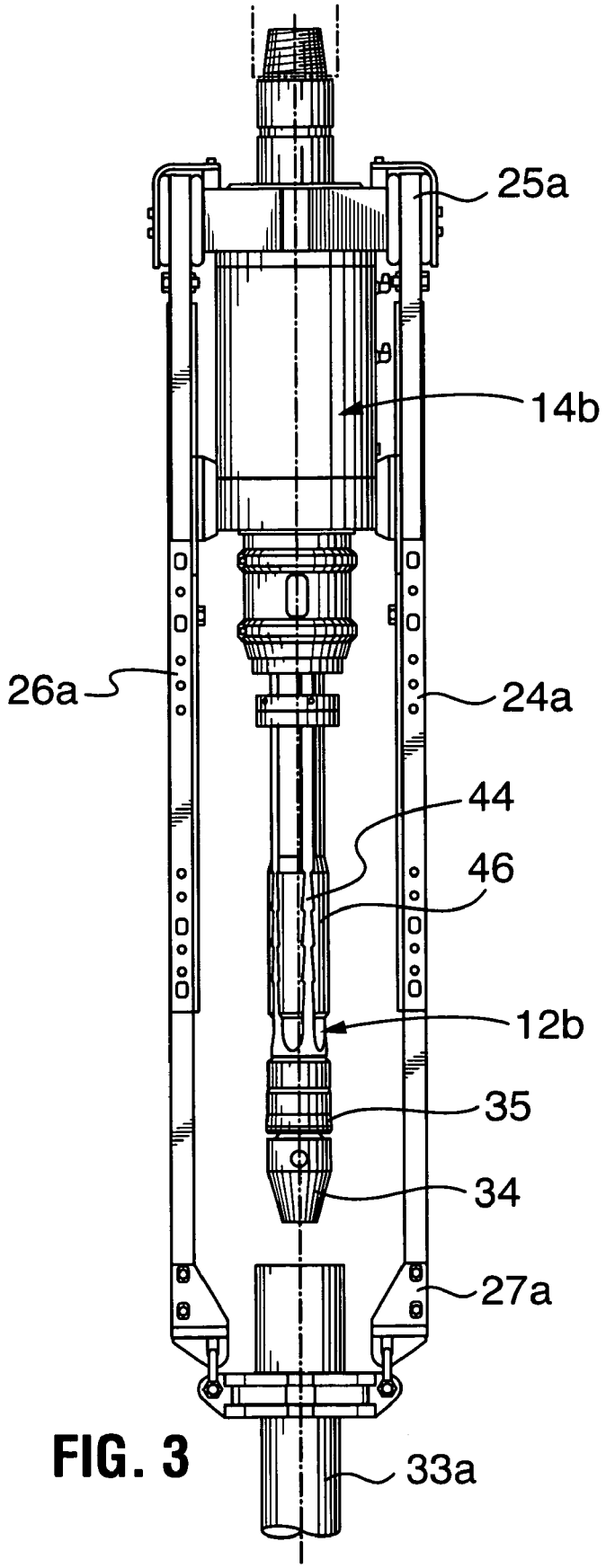
FIG. 3 is a front elevation of another embodiment of a pipe handling system.

In FIG. 3 another pipe handling system is shown. This pipe handling system is as described in FIG. 2, except it includes an internally gripping pipe engaging apparatus 12*b*. Pipe engaging apparatus 12*b* includes a main body 14*b* and a mandrel 44 carrying grapples 46 formed to engage in the inner diameter of a pipe, such as a section of casing 33*a*, to be gripped. The mandrel further carries a stabbing guide 34 and a packer arrangement 35 for insertion into the inner diameter of the pipe to be gripped. Pipe engaging apparatus 12*b* can be, for example, an internal casing drive assembly as is available from TESCO Corporation.

While specific pipe engaging apparatus are illustrated, it is to be understood that the casing handling device as claimed herein can be used with other types of pipe engaging apparatus, such as those employing bladders, packers, etc. rather than grapples, those omitting, or using other, stabbing guides or those omitting, or using other, packer arrangements.

Figure 4:
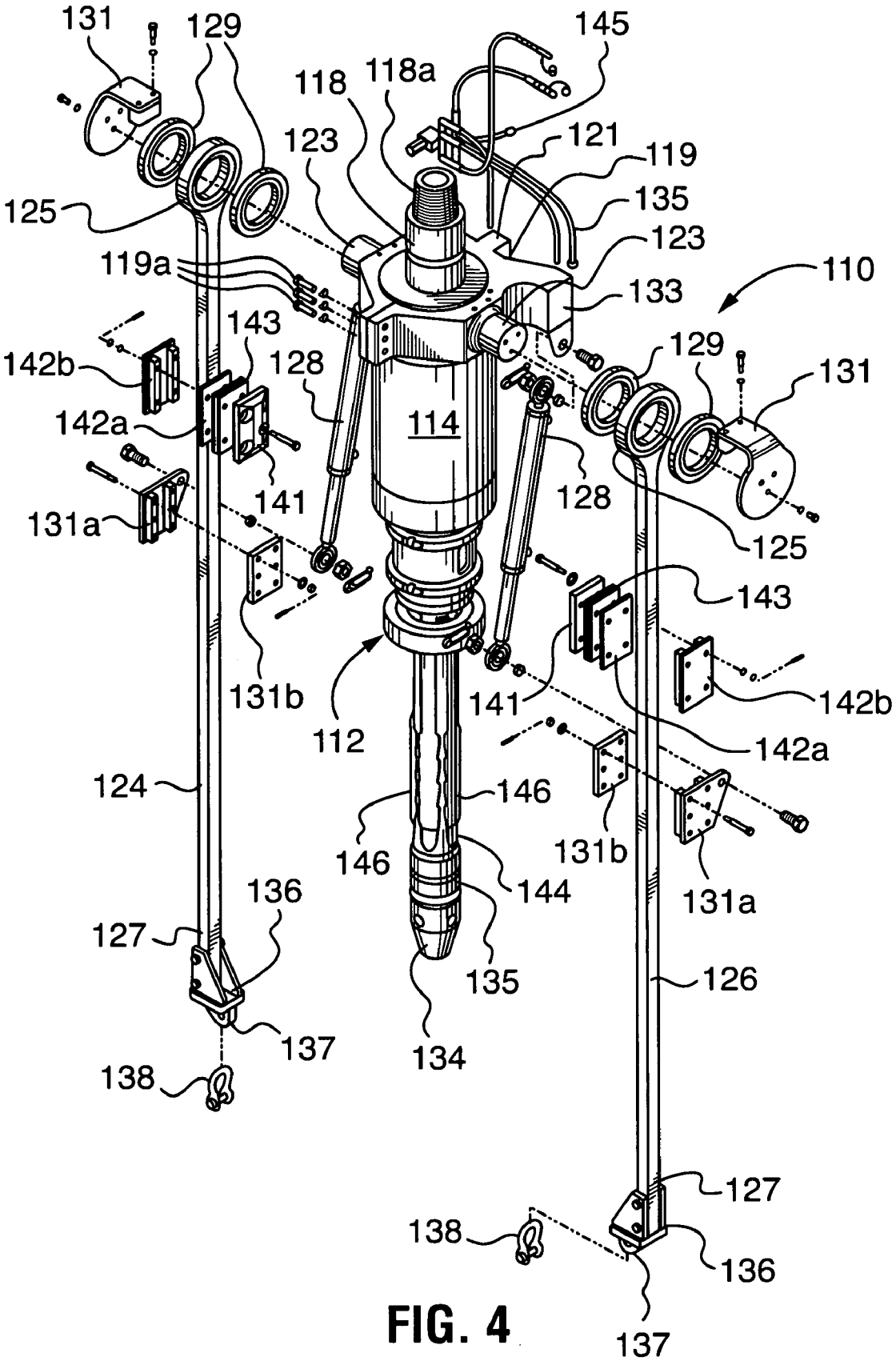
FIG. 4 is an exploded view of an embodiment of a pipe handling system.

Another pipe handling system is shown in exploded configuration in FIG. 4. The pipe handling system includes a pipe handling device 110 and a pipe engaging apparatus 112 including a main body 114 and a mandrel 144 carrying grapples 146 formed to engage in the inner diameter of a pipe to be gripped, a stabbing guide 134 and a packer arrangement 135 for insertion into the inner diameter of the pipe to be gripped. Main body 114 includes hydraulically driven piston for driving grapples 146 over cam surfaces on the mandrel to expand and retract the grapples.

The pipe engaging apparatus can be formed at its upper end 118 as a pin 118*a* for connection to a top drive. Pipe engaging apparatus 112 can be selected to grip, through the grapples, a section of pipe for rotational and/or axial movement thereof, as driven by the top drive. The section of casing can be one or more joints of casing or drill pipe to be added to or removed from a casing string for drilling or lining a wellbore.

Pipe handling device 110 can be used to bring a section of casing from a pipe supply into a position for engagement by pipe engaging apparatus 112.

Pipe handling device 110 is mounted to the pipe engaging apparatus through a bracket 119 clamped by bolts 119*a* about an upper portion of main body 114. Bracket 119 can replace a bracket normally secured about the pipe engaging device and, therefore, can include a key 121 for fitting into the anti-rotation guide slot extending down from the top drive.

Bracket 119 can further include axles 123, formed as shafts, on which a first link arm 124 and a second link arm 126 are mounted for pivotal movement. The first and second link arms can each include a link eye end 125 mountable onto the axles 123. Washers 129 can be mounted on axles 123 on either side of the link arm link eye ends 125 to maintain alignment of the arms on the axles and to tend to maintain the arms in a laterally stable position, stabilized to rotate substantially only in a plane substantially orthogonally to axles 123. In the illustrated embodiment, axles 123 are coaxial such that arms 124, 126 rotate in planes parallel to each other. The use of lateral stabilizers, such as washers 129, can tend to hold link arms equidistant from the main axis of the drilling rig, with which for example, mandrel 144 is aligned. A guard 131 is secured to the bracket at either end of each axle 123 to secure the arms 124, 126 to their axles and tightly between washers 129.

Each link arm includes an outboard end 127 that can have a block 136 attached thereto by bolts. Each block includes a pad eye 137 for retaining a clevis 138 for connection to an elevator.

Pipe handling device 110 further can include a drive system for driving link arms 124, 126 to rotate about axles 123. The drive system can include hydraulic cylinders 128 each connected between a bracket, formed from parts 131*a*, 131*b*, on their associated link arm and a support 133 formed from bracket 119. Supports 133 can be offset horizontally from vertical axis of axles 123 to facilitate control of the link arms with the cylinders. Cylinders 128 are driven by fluid through lines 135. Cylinders 128 can be double acting to provide drive force to move the link arms both clockwise and counterclockwise about their axle shafts. Double acting cylinders and the offset of supports 133 assist in driving the link arms to appropriate positions, for example to bring a pipe section into alignment with, or through in both directions, the rig main axis in which the stabbing guide of the pipe engaging apparatus is aligned. The cylinders can be locked in any desired position, again useful in pipe alignment, and can be unlocked to permit substantially unrestricted movement of the arms.

Pads 141, can be detachably connected, by for example, brackets 142*a*, 142*b* and shims 143, to link arms 124, 126 to maintain a desired spacing between the link arms and the pipe engaging apparatus and to stabilize the arms, when they are in their lower position, extending down substantially with their long axes parallel to the long axis of mandrel 144. Pads 141 can be formed of a material softer than main body 112 so that they do not damage the main body by contact therewith. In one embodiment, for example, the pads can be formed of polymeric material that is softer than the material of the pipe engaging apparatus against which the pads bear. To act to maintain the spacing and to stabilize the arms in their lower position, the pads can be replaced when they become overly worn.

In operation, the pipe handling system is assembled and connected to a top drive in a rig and an elevator is connected to clevises 138. If the elevator is mechanized, it can be placed into communication with a connection 145 to an elevator control mechanism, which can for example, be a connection to an electrical and/or hydraulic line. A pipe can be picked up from a V-door by powering cylinders 128 to drive link arms 124, 126 and thereby the elevator carried thereon to a position beneath the pipe so that the elevator can be connected up around the elevator. The pipe is rotated to the vertical position by hoisting the top drive with the cylinders unlocked. The pipe is stabbed into the stump in the rotary table, or if there is not yet a string in the rotary table, is positioned in the rotary table, and the cylinders are driven to align and maintain alignment of the pipe section while the top drive is lowered until the top of the pipe is engaged by the grapples of the pipe engaging apparatus. When lowering the top drive, the elevator, which catches on an upset on the outer diameter of the pipe, will slide down the outside of the pipe, while continuing to hold the pipe upright.

While bracket 119 is shown and described, it is to be understood that the pipe handling device can be secured in other ways to the pipe engaging device and, if used, bracket can take other forms than that shown. For example, bracket 119 need not be combined with key 121 and bracket can be formed in parts, rather than as one part defining axles 123, extensions 133. Also, bracket can be attached to pipe engaging device by means other than bolts 119*a*. While bolts have been shown as fasteners it is to be understood that other fastening approaches can be used, such as welding or forming parts integral to others. Although, many component assemblies have been shown such as for brackets 131*a*, 131*b*, pads 141, etc., other approaches can be taken, such as forming the components integral with the parts on which they are supported, or increasing or reducing the number and/or configuration of parts.

It will be apparent that many other changes may be made to the illustrative embodiments, while falling within the scope of the invention and it is intended that all such changes be covered by the claims appended hereto.

What is claimed is:

1. A pipe handling device for mounting onto a pipe engaging apparatus, the pipe engaging apparatus including a main body and a pipe gripping mechanism to grip a pipe for rotational and axial movement thereof and being connectable to a top drive, the pipe handling device comprising: a link arm having a first end pivotally connectable to the bracket and an outboard end pivotally connectable to a pipe elevator segment, the link arm being sized to present a pipe lifted by the pipe elevator segment into a position to be gripped by the pipe engaging apparatus; and a connector for connection to an elevator control mechanism.

2. The pipe handling device of claim 1 further comprising a drive system to drive the link arm about its pivotal connection on the pipe engaging apparatus.

3. The pipe handling device of claim 1 wherein the pipe elevator segment is remotely actuable to open and close.

4. The pipe handling device of claim 1 wherein the link arm is pivotally connected to a bracket on the pipe engaging apparatus, the bracket including a channel key.

5. The pipe handling device of claim 1 wherein the link arm is pivotally mounted on an axle supported on the pipe engaging apparatus.

6. The pipe handling device of claim 5 further comprising a second link arm having a first end pivotally connectable to the pipe engaging apparatus and an outboard end pivotally connectable to the pipe elevator segment, the second link arm being pivotally mounted on a second axle supported on the pipe engaging apparatus and wherein the axles are spaced apart and axially aligned.

7. The pipe handling device of claim 6 wherein the outboard ends are mounted to remain substantially equidistant from the pipe gripping mechanism.

8. The pipe handling device of claim 5 further comprising a drive system including a hydraulic cylinder to drive the link arm about the axle, the hydraulic cylinder connected between the link arm and a support offset horizontally from a vertical plane aligned with the long axis of the axle shaft.

9. The pipe handling device of claim 1 wherein the link arm is laterally stabilized to rotate substantially in a plane.

10. The pipe handling device of claim 1 further comprising a drive system including a hydraulic cylinder to drive the link arm about its pivotal connection on the pipe engaging apparatus, the hydraulic cylinder selected to move the link arm in both a clockwise and a counterclockwise direction about its pivotal connection.

11. The pipe handling device of claim 1 wherein the link arm is fitted for anti-rotation relative to the rotational movement applied by the pipe gripping mechanism to a pipe gripped thereby.

12. The pipe handling device of claim 1 wherein the link arm is pivotally connected to a bracket on the pipe engaging apparatus, the bracket fitting to an anti-rotation bracket extending from the top drive.

13. A pipe handling system comprising: a pipe engaging apparatus for gripping a pipe joint and having a main body including an upper end for drive connection to a top drive and a pipe gripping mechanism, a link arm including a pivotal connection to the pipe engaging apparatus main body and an outboard end and the link arm being elongate to extend to a position below the pipe gripping mechanism and a link arm drive system for driving the link arm about its pivotal connection.

14. The pipe handling system of claim 13 wherein the drive system includes a hydraulic cylinder to drive the link arm.

15. The pipe handling system of claim 14 wherein the drive system includes a hydraulic cylinder connected between the link arm and a support, the support being offset horizontally from a vertical plane aligned with the long axis of the axle shaft.

16. The pipe handling system of claim 13 wherein the link arm is telescopically extendable.

17. The pipe handling system of claim 16 wherein the outboard ends are mounted to remain when driven substantially equidistant from the pipe gripping mechanism.

18. The pipe handling system of claim 13 wherein the link arm is pivotally connected to a bracket on the pipe engaging apparatus, the bracket including a channel key.

19. The pipe handling system of claim 13 wherein the link arm pivotal connection includes an axle supported on the pipe engaging apparatus.

20. The pipe handling system of claim 19 further comprising a second link arm having a first end pivotally connectable to the pipe engaging apparatus and an outboard end, the second link arm being pivotally mounted on a second axle supported on the pipe engaging apparatus and wherein the axles are spaced apart and axially aligned.

21. The pipe handling system of claim 13 wherein the link arm is laterally stabilized to rotate substantially in a plane.

22. The pipe handling system of claim 13 wherein the drive system includes a hydraulic cylinder selected to move the link arm in both a clockwise and a counterclockwise direction about its pivotal connection.

23. The pipe handling system of claim 13 further comprising a pipe elevator pivotally connected to the outboard end of link arm.

24. The pipe handling system of claim 23 wherein the pipe elevator is mechanized to open and close by a remote tool operator.

25. The pipe handling system of claim 13 wherein the link arm is fitted for anti-rotation relative to the rotational movement applied by the pipe gripping mechanism to a pipe gripped thereby.

26. The pipe handling system of claim 13 wherein the link arm is pivotally connected to a bracket on the pipe engaging apparatus, the bracket fitting to an anti-rotation bracket extending from the top drive.

27. A method for handling pipe in a rig, the rig including a rotary table, a top drive with a pipe engaging apparatus secured therebelow and a link arm on the pipe engaging apparatus and capable of pivoting relative to the pipe engaging apparatus, the method comprising: using the link arm to pick up a pipe from a pipe supply, hoisting the top drive in the rig such that the pipe is rotated to a substantially vertical position while remaining engaged by the link arm, positioning a lower end of the pipe onto a joint positioned in the rotary table such that the pipe is supported thereby, slidably holding an upper portion of the pipe with the link arm, lowering the top drive until the upper portion of the pipe is engaged by the pipe engaging apparatus, driving the pipe to connect it to the joint, the link arm being fitted for anti-rotation relative to any rotational drive of the pipe engaging apparatus, lowering the pipe until it is supported in the rotary table and disengaging the pipe engaging apparatus from the pipe.

28. The method for handling pipe in a rig as in claim 27 further comprising substantially stabilizing the link arm against lateral movement while lowering the top drive until the upper portion of the pipe is engaged by the pipe engaging apparatus.

29. The method for handling pipe in a rig as in claim 27 further comprising driving the link arm in at least one of a clockwise or a counterclockwise direction to align the upper portion of the pipe with the pipe engaging apparatus.

30. A method for handling pipe in a rig, the rig including a rotary table, a top drive with a pipe engaging apparatus secured therebelow to define a main axis of the rig, the method comprising: providing a link arm mounted by a pivotal connection to move with the top drive, the link arm driven to pivot about its pivotal connection through a plane of rotation at least between a lowered position and a raised position and substantially stabilized when in the lowered position against moving out of the plane of rotation, using the link arm to pick up a pipe from a pipe supply, hoisting the top drive in the rig such that the pipe is rotated to a substantially vertical position while remaining engaged by the link arm, positioning a lower end of the pipe section onto a joint positioned in the rotary table such that the pipe is supported thereby, slidably holding an upper portion of the pipe with the link arm, lowering the top drive until the upper portion of the pipe is engaged by the pipe engaging apparatus, driving the pipe to connect it to the joint, the link arm being fitted for anti-rotation relative to any rotational drive of the pipe engaging apparatus, lowering the pipe until it is supported in the rotary table and disengaging the pipe engaging apparatus from the pipe.

31. The method for handling pipe in a rig as in claim 30 further comprising substantially stabilizing the link arm against lateral movement while lowering the top drive.

32. The method for handling pipe in a rig as in claim 30 further comprising driving the link arm in at least one of a clockwise or a counterclockwise direction to align the upper portion of the pipe with the pipe engaging apparatus.

33. A well drilling and completion system for manipulating tubulars comprising: a vertically movable power drive assembly for providing rotary movement in a well device, a longitudinally extending output shaft rotatably turned about its longitudinal axis by the power drive assembly and movable vertically therewith, a pipe gripping mechanism coupled to and driven by the output shaft, the pipe gripping mechanism having a lower end selected to grip and rotate an end of the tubular segment, at least one bail arm having upper and lower ends with the upper end pivotally carried by the pipe gripping mechanism, and a lifting elevator carried by the lower end of the bail arm, the bail arm being dimensioned with respect to the pipe gripping mechanism such that a top end of a tubular engaged by the lifting elevator is positioned below the lower end of the pipe gripping mechanism when the lifting elevator is aligned with the longitudinal axis.

34. The well drilling and completion system of claim 33 wherein the at least one bail includes a first bail and a second bail, each of the first bail and the second bail being rotatable at least between a lower position and a raised position and wherein rotation of the first bail and the second bail each define rotation planes that are substantially parallel to each other.

35. The well drilling and completion system of claim 33 further comprising a drive system to drive movement of the at least one bail.

36. The well drilling and completion system of claim 35 wherein the drive system includes a hydraulic cylinder connected to drive movement of the at feast one bail.

37. The well drilling and completion system of claim 33 wherein the link arm is fitted for anti-rotation relative to the rotational movement applied by the pipe gripping mechanism to a pipe gripped thereby.

38. The well drilling and completion system of claim 33 wherein the link arm is pivotally connected to a bracket on the pipe engaging apparatus, the bracket fitting to an anti-rotation bracket extending from the top drive.

39. A method for adding a tubular segment to a stump of a tubular string, the tubular segment having a shaft between top and bottom ends and female threads at the top end and male threads at the bottom end and the stump of the tubular string positioned in a wellbore secured by a rotary table of a drilling rig and the stump comprising female threads, the method comprising the steps of: installing in a drilling rig a vertically moveable top drive which provides rotary movement to a longitudinally extending output shaft along the top drive longitudinal axis and moveable therewith; coupling pipe engaging apparatus to the output shaft of the top drive; pivotally coupling a pipe handling assembly to the pipe engaging apparatus, the pipe handling apparatus having a lifting elevator at a lower end of the apparatus; lifting an upper end of the tubular segment with the lifting elevator by raising the top drive in the drilling rig and vertically positioning the top drive until the tubular segment is substantially vertically aligned with the stump of the tubular string; lowering the top drive until the male threads of the tubular segment are set down in the female threads of the stump of the tubular string; lowering the top drive to a position so that the pipe engaging apparatus grips the top end of the tubular segment while the lifting elevator slides down along and supports the shaft of the tubular segment in a substantially vertical position; and rotating the top drive so that the pipe engaging apparatus rotates while gripping the tubular segment to connect the male threads of the tubular segment to the female threads of the stump of the string.

40. The method for adding a tubular segment to a stump of a tubular string as in claim 39 further comprising substantially stabilizing the pipe handling apparatus against lateral movement while lowering the top drive until the pipe engaging apparatus grips the top end of the tubular segment.

41. The method for adding a tubular segment to a stump of a tubular string as in claim 39 further comprising driving the lifting elevator to align the top end of the tubular segment with the pipe engaging apparatus.

42. The method for adding a tubular segment to a stump of a tubular string as in claim 39 wherein during the step of rotating the top drive to connect the male threads of the tubular segment to the female threads of the stump of the string, the pipe handling assembly is fitted for anti-rotation relative to any rotation of the top drive.

43. A pipe handling device for mounting onto a pipe engaging apparatus, the pipe engaging apparatus including a main body and a pipe gripping mechanism to grip a pipe for rotational and axial movement thereof and being connectable to a top drive, the pipe handling device comprising: a bracket on the pipe engaging apparatus, the bracket including a channel key; and a link arm having a first end pivotally connectable to the bracket and an outboard end pivotally connectable to a pipe elevator segment, the link arm being sized to present a pipe lifted by the pipe elevator segment into a position to be gripped by the pipe engaging apparatus.

44. The pipe handling device of claim 43 further comprising a drive system to drive the link arm about its pivotal connection on the bracket.

45. The pipe handling device of claim 43 further comprising an axle formed on the bracket and wherein the link arm is pivotally mounted on the axle.

46. The pipe handling device of claim 45 further comprising a second axle formed on the bracket and wherein the axles are spaced apart and axially aligned; and a second link arm having a first end pivotally mounted on the second axle and an outboard end pivotally connectable to the pipe elevator segment.

47. The pipe handling device of claim 46 wherein the outboard ends are mounted to remain substantially equidistant from the pipe gripping mechanism.

48. The pipe handling device of claim 45 further comprising a drive system including a hydraulic cylinder to drive the link arm about the axle, the hydraulic cylinder connected between the link arm and a support offset horizontally from a vertical plane aligned with the long axis of the axle shaft.

49. The pipe handling device of claim 43 wherein the link arm is laterally stabilized to rotate substantially in a plane.

50. The pipe handling device of claim 43 further comprising a drive system including a hydraulic cylinder to drive the link arm about its pivotal connection on the bracket, the hydraulic cylinder selected to move the link arm in both a clockwise and a counterclockwise direction about its pivotal connection.

51. A pipe handling device for mounting onto a pipe engaging apparatus, the pipe engaging apparatus including a main body and a pipe gripping mechanism to grip a pipe for rotational and axial movement thereof and being connectable to a top drive, the pipe handling device comprising: an axle supported on the pipe engaging apparatus; a link arm having a first end pivotally connectable to the axle and an outboard end pivotally connectable to a pipe elevator segment, the link arm being sized to present a pipe lifted by the pipe elevator segment into a position to be gripped by the pipe engaging apparatus; and a drive system including a hydraulic cylinder to drive the link arm about the axle, the hydraulic cylinder connected between the link arm and a support offset horizontally from a vertical plane aligned with the long axis of the axle shaft.

52. The pipe handling device of claim 51 further comprising a second axle supported on the pipe engaging apparatus and wherein the axle and the second axle are spaced apart and axially aligned; and a second link arm having a first end pivotally mounted on the second axle and an outboard end pivotally connectable to the pipe elevator segment.

53. The pipe handling device of claim 52 wherein the outboard ends are mounted to remain substantially equidistant from the pipe gripping mechanism.

54. The pipe handling device of claim 51 wherein the link arm is laterally stabilized to rotate substantially in a plane.

55. A pipe handling device for mounting onto a pipe engaging apparatus, the pipe engaging apparatus including a main body and a pipe gripping mechanism to grip a pipe for rotational and axial movement thereof and being connectable to a top drive, the pipe handling device comprising: a link arm having a first end pivotally connectable to the pipe engaging apparatus and an outboard end pivotally connectable to a pipe elevator segment, the link arm being sized to present a pipe lifted by the pipe elevator segment into a position to be gripped by the pipe engaging apparatus; and a drive system including a hydraulic cylinder to drive the link arm about its pivotal connection on the pipe engaging apparatus, the hydraulic cylinder selected to move the link arm in both a clockwise and a counterclockwise direction about its pivotal connection.

56. The pipe handling device of claim 55 wherein the link arm is laterally stabilized to rotate substantially in a plane.

57. The pipe handling device of claim 55 further comprising a second link arm having a first end pivotally connectable to the pipe engaging apparatus and an outboard end pivotally connectable to the pipe elevator segment and the drive system further includes a second hydraulic cylinder to drive the second link arm about its pivotal connection on the pipe engaging apparatus, the second hydraulic cylinder selected to move the second link arm in both a clockwise and a counterclockwise direction about its pivotal connection.

58. The pipe handling device of claim 57 wherein the drive system maintains the outboard ends of the link arm and the second link arm substantially equidistant from the pipe gripping mechanism.

59. A pipe handling device for mounting onto a pipe engaging apparatus, the pipe engaging apparatus including a main body and a pipe gripping mechanism to grip a pipe for rotational and axial movement thereof and being connectable to a top drive, the pipe handling device comprising: a link arm having a first end pivotally connectable to the pipe engaging apparatus and an outboard end pivotally connectable to a pipe elevator segment, the link arm being sized to present a pipe lifted by the pipe elevator segment into a position to be gripped by the pipe engaging apparatus and the link arm being fitted for anti-rotation relative to the rotational movement applied by the pipe gripping mechanism to a pipe gripped thereby.

60. The pipe handling device of claim 59 wherein the link arm is fitted for anti-rotation by including a key for fitting into an anti-rotation guide slot extending from the top drive.

61. The pipe handling device of claim 59 further comprising a drive system to drive the link arm about its pivotal connection.

62. The pipe handling device of claim 59 further comprising an axle supported on the pipe engaging apparatus and wherein the link arm is pivotally mounted on the axle.

63. The pipe handling device of claim 62 further comprising a drive system including a hydraulic cylinder to drive the link arm about the axle, the hydraulic cylinder connected between the link arm and a support offset horizontally from a vertical plane aligned with the long axis of the axle.

64. The pipe handling device of claim 63 wherein the hydraulic cylinder selected to move the link arm in both a clockwise and a counterclockwise direction about its pivotal connection.

65. The pipe handling device of claim 62 further comprising a second axle supported on the pipe engaging apparatus and wherein the axles are spaced apart and axially aligned; and a second link arm having a first end pivotally mounted on the second axle and an outboard end pivotally connectable to the pipe elevator segment.

66. The pipe handling device of claim 65 wherein the outboard ends are mounted to remain substantially equidistant from the pipe gripping mechanism.

67. The pipe handling device of claim 59 wherein the link arm is laterally stabilized to rotate substantially in a plane.

68. The pipe handling device of claim 59 further comprising a bracket supported on the pipe engaging apparatus, the bracket fitting to an anti-rotation bracket extending from the top drive and wherein the link arm is pivotally connected to the bracket to achieve its pivotal connection on the pipe engaging apparatus.

69. A pipe handling device for mounting onto a pipe engaging apparatus, the pipe engaging apparatus including a main body and a pipe gripping mechanism to grip a pipe for rotational and axial movement thereof and being connectable to a top drive, the pipe handling device comprising: a bracket on the pipe engaging apparatus, the bracket fitting to an anti-rotation bracket extending from the top drive; and a link arm having a first end pivotally connectable to the bracket and an outboard end pivotally connectable to a pipe elevator segment, the link arm being sized to present a pipe lifted by the pipe elevator segment into a position to be gripped by the pipe engaging apparatus.

70. The pipe handling device of claim 69 wherein the bracket is fitted for anti-rotation by including a key for fitting into an anti-rotation guide slot extending from the top drive.

* * * * *

US007140443C1

(12) INTER PARTES REEXAMINATION CERTIFICATE (581st)

United States Patent

Beierbach et al.

(10) Number: US 7,140,443 C1

(45) Certificate Issued: Apr. 23, 2013

(54) PIPE HANDLING DEVICE, METHOD AND SYSTEM

(75) Inventors: K. Evert Beierbach, Calgary (CA); Kevin Nikiforuk, Calgary (CA)

(73) Assignee: Tesco Corporation, Calgary, Alberta (CA)

Reexamination Request:
No. 95/000,407, Oct. 21, 2008

Reexamination Certificate for:

| | |
|---|---|
| Patent No.: | **7,140,443** |
| Issued: | **Nov. 28, 2006** |
| Appl. No.: | **10/704,147** |
| Filed: | **Nov. 10, 2003** |

(51) Int. Cl.
*E21B 19/16* (2006.01)

(52) U.S. Cl.
USPC ..... 166/380; 166/77.52; 166/78.1; 166/85.1; 175/171

(58) Field of Classification Search ..... None
See application file for complete search history.

(56) References Cited

To view the complete listing of prior art documents cited during the proceeding for Reexamination Control Number 95/000,407, please refer to the USPTO's public Patent Application Information Retrieval (PAIR) system under the Display References tab.

*Primary Examiner* — Joseph Kaufman

(57) ABSTRACT

A pipe handling device for mounting to use with a top drive and possibly a pipe engaging apparatus, includes a link arm having a first end pivotally connectable to move with the top drive and an outboard end pivotally connectable to a pipe elevator segment, and a drive system to drive the outboard end of the link arm at least between a lower position and a raised position. A pipe handling system and method may include or employ the pipe handling device.

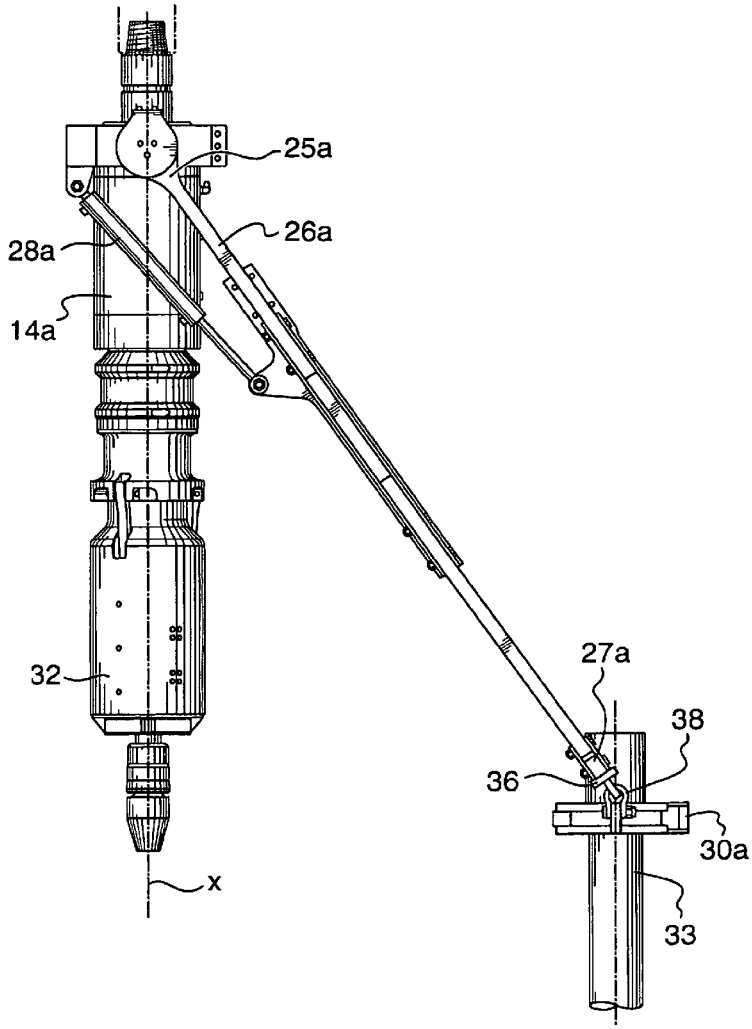

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 13, 14, 16-25, 27-35 and 39-68 is confirmed.

Claims 1-12, 69 and 70 are cancelled.

Claims 15, 26 and 36-38 are determined to be patentable as amended.

15. The pipe handling system of claim 14 wherein the drive system includes a hydraulic cylinder connected between the link arm and a support, the support being offset horizontally from a vertical plane aligned with the long axis of the [axle shaft] *pivotal connection*.

26. The pipe handling system of claim 13 wherein the link arm is pivotally connected to a bracket on the pipe engaging apparatus, the bracket fitting to an anti-rotation [bracket] *guide slot* extending from the top drive.

36. The well drilling and completion system of claim 35 wherein the drive system includes a hydraulic cylinder connected to drive movement of the at [feast] *least* one bail.

37. The well drilling and completion system of claim 33 wherein the [link] *bail* arm is fitted for anti-rotation relative to the rotational movement applied by the pipe gripping mechanism to a pipe gripped thereby.

38. The well drilling and completion system of claim 33 wherein the [link] *bail* arm is pivotally connected to a bracket on the pipe engaging apparatus, the bracket fitting to an anti-rotation [bracket] *guide slot* extending from the top drive.

* * * * *